US009454931B2

(12) United States Patent
Schwanenberger et al.

(10) Patent No.: US 9,454,931 B2
(45) Date of Patent: Sep. 27, 2016

(54) LUMINOUS DISPLAY AND METHOD FOR CONTROLLING THE SAME

(71) Applicant: Thomson Licensing, Boulogne-Billancourt (FR)

(72) Inventors: Thomas Schwanenberger, St. Georgen (DE); Heinrich Schemmann, Villingen-Schwenningen (DE); Thilo Marx, Villingen-Schwenningen (DE)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 14/468,082

(22) Filed: Aug. 25, 2014

(65) Prior Publication Data

US 2014/0361963 A1 Dec. 11, 2014

Related U.S. Application Data

(63) Continuation of application No. 12/085,977, filed as application No. PCT/EP2006/066772 on Sep. 7, 2006, now Pat. No. 8,816,942.

(30) Foreign Application Priority Data

Dec. 8, 2005 (EP) ..... 05301027

(51) Int. Cl.
*G09G 3/30* (2006.01)
*G09G 3/32* (2016.01)

(52) U.S. Cl.
CPC .... *G09G 3/3233* (2013.01); *G09G 2300/0842* (2013.01); *G09G 2300/0861* (2013.01); *G09G 2320/029* (2013.01); *G09G 2320/0295* (2013.01); *G09G 2320/043* (2013.01)

(58) Field of Classification Search
CPC ..... G09G 3/3233–3/325; G09G 2300/0842; G09G 2300/0861; G09G 2320/029; G09G 2320/0295; G09G 2320/043
USPC ..... 345/76–83, 204
See application file for complete search history.

(56) References Cited

U.S. PATENT DOCUMENTS 6,091,203 A 7/2000 Kawashima et al.
7,310,077 B2 12/2007 Kane (Continued)

FOREIGN PATENT DOCUMENTS

EP 0923067 A1 6/1999
EP 1221686 A2 7/2002

(Continued)

OTHER PUBLICATIONS

PCT Search Report, PCT/EP/2006/066772, dated Nov. 1, 2007, English.

*Primary Examiner* — Stephen Sherman
*Assistant Examiner* — Aaron Midkiff
(74) *Attorney, Agent, or Firm* — International IP Law Group, PLLC

(57) ABSTRACT

A luminous display includes pixels arranged in rows and columns. Control signals that are used for controlling first switches for measuring parameters of pixel cells in a first row are also used to control second switches for programming pixel cells in a second row. In this way it is possible to use a single control signal for selecting one pixel cell for programming and simultaneously selecting another pixel cell for measuring. Programming and measuring are thus performed in a time staggered manner, while the addressing is moved to the respective next row. The programming is preferably voltage programming. In one embodiment the current through the pixel cell that is currently programmed is interrupted. In another embodiment the measuring is performed only after the transient current into signal holding means coupled to current control means has set.

9 Claims, 5 Drawing Sheets

(56) References Cited

U.S. PATENT DOCUMENTS

| | | | |
|---|---|---|---|
| 7,358,942 | B2 | 4/2008 | Yamazaki et al. |
| 7,432,888 | B2 | 10/2008 | Kwak |
| 7,554,451 | B2 | 6/2009 | Carrender et al. |
| 7,554,514 | B2 | 6/2009 | Nozawa |
| 7,893,895 | B2 | 2/2011 | Uchino et al. |
| 8,068,078 | B2 | 11/2011 | Lee et al. |
| 2001/0024186 | A1 | 9/2001 | Kane et al. |
| 2002/0101395 | A1 | 8/2002 | Inukai |
| 2003/0052841 | A1 | 3/2003 | Tanaka et al. |
| 2003/0062524 | A1 | 4/2003 | Kimura |
| 2003/0090446 | A1 | 5/2003 | Tagawa et al. |
| 2003/0103022 | A1 | 6/2003 | Noguchi et al. |
| 2004/0100430 | A1 | 5/2004 | Fruehauf |
| 2004/0108518 | A1 | 6/2004 | Jo |
| 2006/0139261 | A1 | 6/2006 | Choi et al. |

FOREIGN PATENT DOCUMENTS

| | | | |
|---|---|---|---|
| EP | 1315141 | A2 | 5/2003 |
| GB | 2360870 | A | 10/2001 |
| JP | 2003280585 | | 10/2003 |
| WO | 20040023446 | A1 | 3/2004 |
| WO | 2004034365 | A1 | 4/2004 |
| WO | 2005109389 | A1 | 11/2005 |
| WO | 2007065741 | A1 | 6/2007 |

LUMINOUS DISPLAY AND METHOD FOR CONTROLLING THE SAME

CROSS REFERENCE TO RELATED APPLICATION

This application claims priority to U.S. Ser. No. 12/085,977, filed on Jun. 3, 2008, PCT application PCT/EP2006/066772, filed on Sep. 7, 2006, and European (EP) Patent Application No. 05 301 027.8, filed on Dec. 8, 2005, the contents of which are incorporated by reference as if set forth in their entirety herein for all of these applications.

BACKGROUND

The invention relates to a luminous display, in particular to a luminous display including OLEDs, or organic light emitting diodes, for controllably emitting light. The invention further relates to a method for controlling a display according to the invention.

OLED pixel cells suffer from degrading performance throughout the display's life due to ageing. Further, the electro-optical properties of the pixel cells can vary across the display screen due to imperfections in the manufacturing process. In order to compensate for this effect, measuring the properties of the pixel cell and adapting the drive signals, in particular for voltage driven OLED pixel cells, is commonly used. Driving OLED pixel cells using a drive voltage rather than a control current allows for faster setting the desired amount of light to be emitted. Measuring the properties of the OLED pixel cell during normal operation, however, requires additional power supply, control and measuring lines, which reduce the effective area through which light is emitted. On the other hand, measuring during specific measurement cycles, e.g. each time when the display is switched on, using the same lines as are used for programming reduces the number of additional lines but does not allow for permanent adaptation of the driving signal.

It is, therefore, desirable to provide a luminous display and a method for controlling the same, which allow for measuring the properties of the display elements during normal operation.

SUMMARY

In a luminous display according to the invention, control lines for controlling first and/or third switches of pixel cells that are arranged in a first row also control second switches of pixel cells that are arranged in a second row, wherein the first row and the second row, in one embodiment, are adjacent to each other. During driving of the display current controlling means of pixel cells that are arranged in the second row are programmed to conduct a desired current while at the same time the current and/or the voltage of the pixel cells that are arranged in the first row is measured. Once one row is programmed and the other row is measured, the addressing of the rows is moved on, i.e. the row that was programmed in the preceding cycle may now be measured. After all rows have been programmed and measured, preferably in accordance with a driving scheme like, e.g. a row-by-row scanning from the top row of the display to the bottom row of the display, programming and measuring begins anew from the top row of the display. In this way it is possible to measure properties of elements of pixel cells of luminous displays during normal operation in a time staggered manner, while reducing the number of control lines necessary for conducting the measurement.

In one embodiment of the invention one single line is provided for measuring the current through the pixel cell that is already programmed and applying the programming voltage to the next pixel cell to be programmed, thereby further reducing the number of control lines required in the display. Since the programming signal settles rather quickly, the remaining time that is available for programming of the row can be used for measuring a row that had been programmed before. The time that is available for programming and measuring a row depends on the rate at which the image information is refreshed and the number of rows in the display.

BRIEF DESCRIPTION OF THE DRAWINGS

The invention will be described in the following with reference to the drawing. In the drawing

In the figures, same or similar elements are referenced using the same reference symbol.

FIG. 5 is for purposes of better overview only and will be referred to in the description of FIGS. 1 to 4 where appropriate.

DETAILED DESCRIPTION OF SPECIFIC EMBODIMENTS

Figure 1:
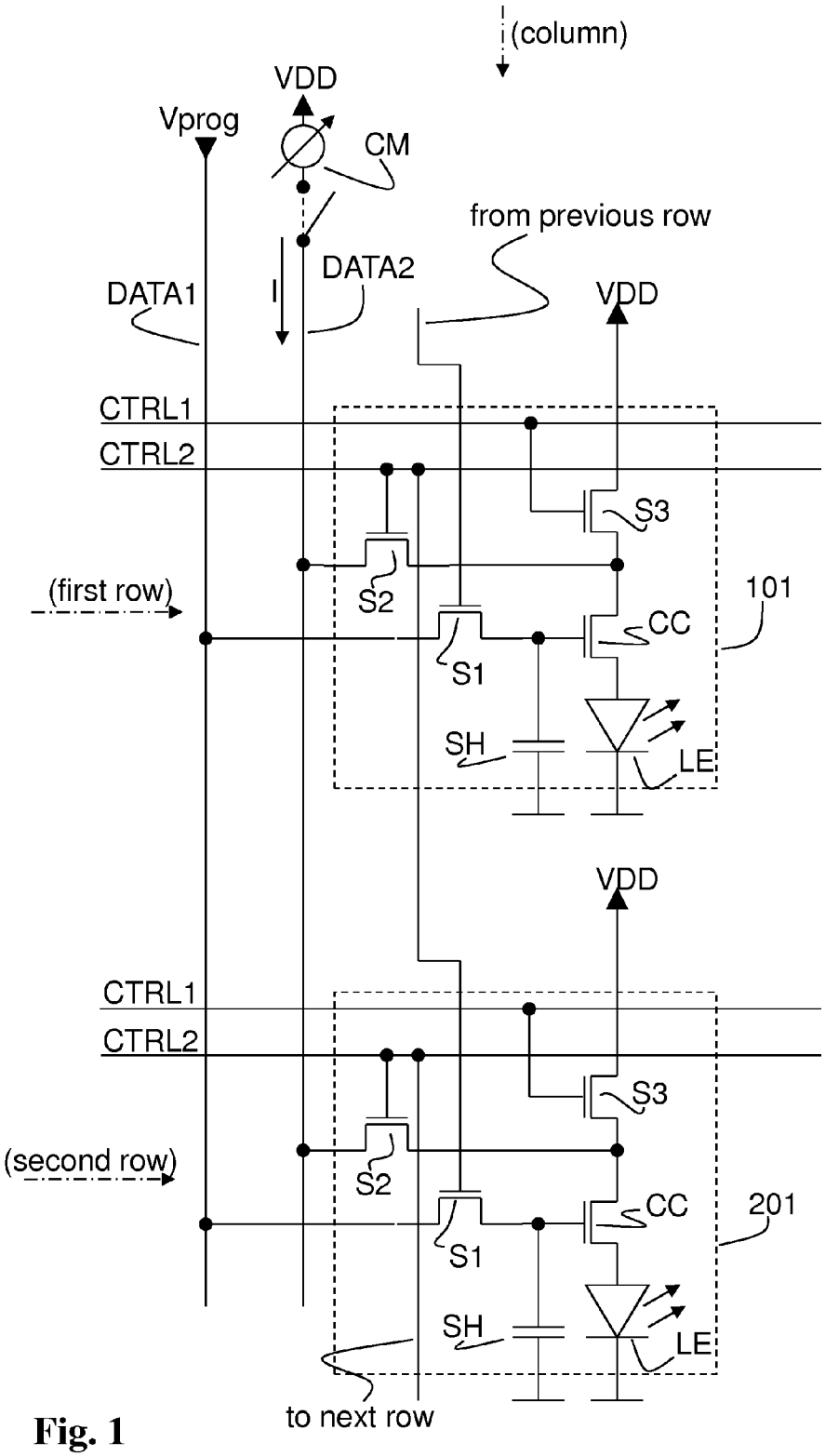
FIG. 1 shows a detail of a luminous display according to a first embodiment of the invention.

In a luminous display according to a first embodiment of the invention a multiplicity of pixel cells 101, 201 are arranged in rows and columns FIG. 1 shows a detail of the luminous display according to the first embodiment of the invention. In the figure pixel cells 101, 201 of two adjacent rows of the display are shown. A pixel cell 101, 201 includes a light emitting element LE, a current controlling means CC and a third switch S3 connected in series between ground and a supply voltage VDD. The control terminals of the current controlling means CC of pixel cells 101, 201 that are arranged in the same column are switchably connected to a first data line DATA1 via first switches S1. The first data line DATA1 is used for programming the current control means CC to provide a desired current. The number of first data lines DATA1 preferably equals the number of columns in the display. Further, signal holding means SH are connected to the control terminals of each current controlling means CC, for maintaining a set control signal and thus for maintaining the programmed current. Second switches S2 connect respective junctions of third switches S3 and current controlling means CC to a second data line DATA2. The number of second data lines DATA2 preferably equals the number of columns in the display. A first control line CTRL1 is provided for controlling the third switches S3 of pixel cells 101, 201 that are arranged in one row. The number of first control lines CTRL1 preferably equals the number of rows in the display.

A second control line CTRL2 is provided for controlling the second switches S2 of pixel cells 101, 201 arranged in a first row and the first switches S1 of pixel cells arranged in a second row, wherein the first and the second rows are adjacent to each other. In other words, the second control line CTRL2 controls the second switches S2 of those pixel cells 101, 201 that are arranged in the same row as the control line CTRL2 and the first switches S1 of those pixel cells 101, 201 that are arranged in the next, adjacent row. In a development of the first embodiment of the invention the bottom most second control line CTRL2 of the display controls the second switches S2 of the pixel cells 101, 201 arranged in the bottom most row of the display and the first switches S1 of the pixel cells 101, 201 arranged in the topmost row of the display.

Figure 5:
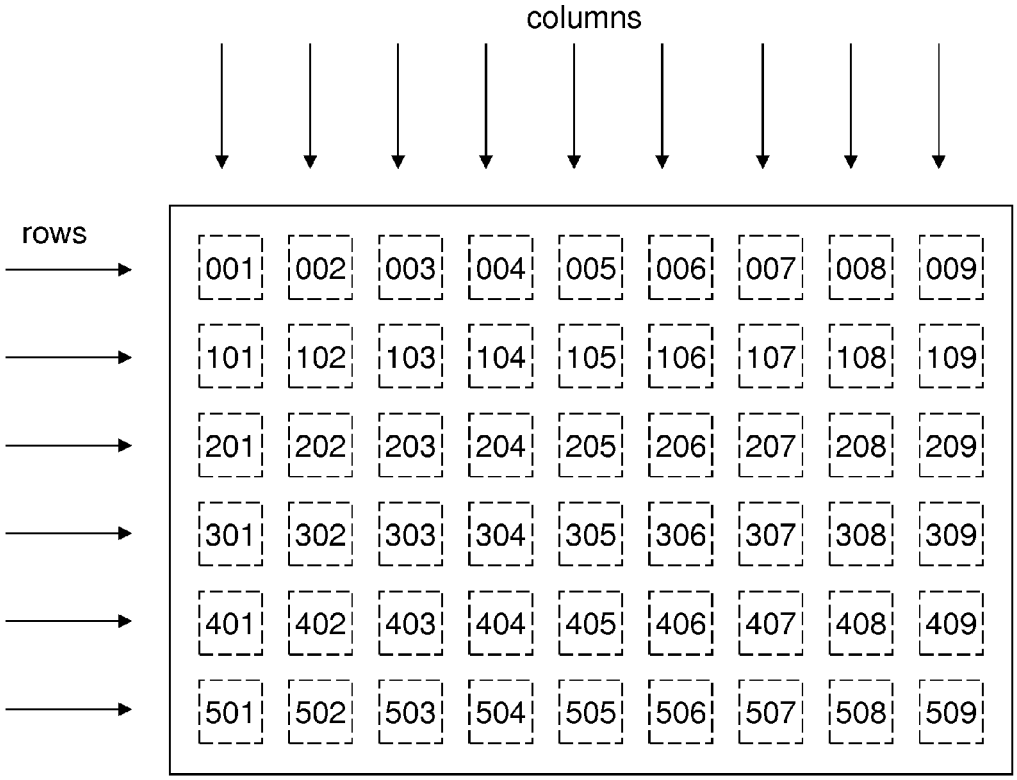
FIG. 5 is a schematic overview of pixel cells arranged in rows and columns.

A method for driving a luminous display according to the first embodiment of the invention includes the following steps: the third switch S3 of a pixel cell 101 in a first row is opened in order to interrupt the current flow through the current control means CC and the light emitting element LE. Opening of the third switch S3 of the pixel cell is done by accordingly applying a signal to the first control line CTRL1 in the first row. The first switch S1 of the pixel cell 201 is closed, thereby connecting the control terminal of the current control means CC to the first data line DATA1. A programming voltage Vprog is applied to the control terminal of the current control means CC via the closed first switch S1 and the first data line DATA1. The first switch S1 of the pixel cell 201 in the second row is controlled by an according signal in the second control line CTRL2 in the first row. The signal in the second control line CTRL2 in the first row also closes the second switch S2 of the pixel cell 101 in the first row, thereby connecting the junction between the third switch S3 and the current control means CC with the second data line DATA2. Via the second data line DATA2 the current flowing through the current control means CC and the light emitting element LE of the pixel cell 101 in the first row is supplied and measured. After programming and measuring of the pixel cells 101, 201 the third switches S3 are closed again and the first and second switches S1, S2 are opened again. Once the programming and measuring of the pixel cells 101, 201 in the first and the second row is terminated, the second row, i.e. the row including pixel cell 201 in FIG. 5, becomes the new first row and the next row, i.e. the row including pixel cell 301 in FIG. 5, becomes the new second row. The method is repeated until all the rows of the display have been programmed and measured, respectively, and then the method begins anew from the beginning, e.g. from the top row of the display, i.e. the row including the pixel cell 001, when the display is driven in a row-by-row fashion. The method allows for continuously measuring the electrical properties of the pixel cells of the display during the normal driving cycles, in which new image content is written to the display. It is to be noted that opening the third switch S3 is not necessary for performing the programming of the current control means CC of a pixel cell. In this case a possible change in the current that is programmed is visible as an increasing or decreasing brightness of the light emitting means LE. In case the third switch S3 is opened prior to programming a new current those light emitting elements LE the current control means CC of which are currently programmed will not emit any light during programming.

Figure 2:
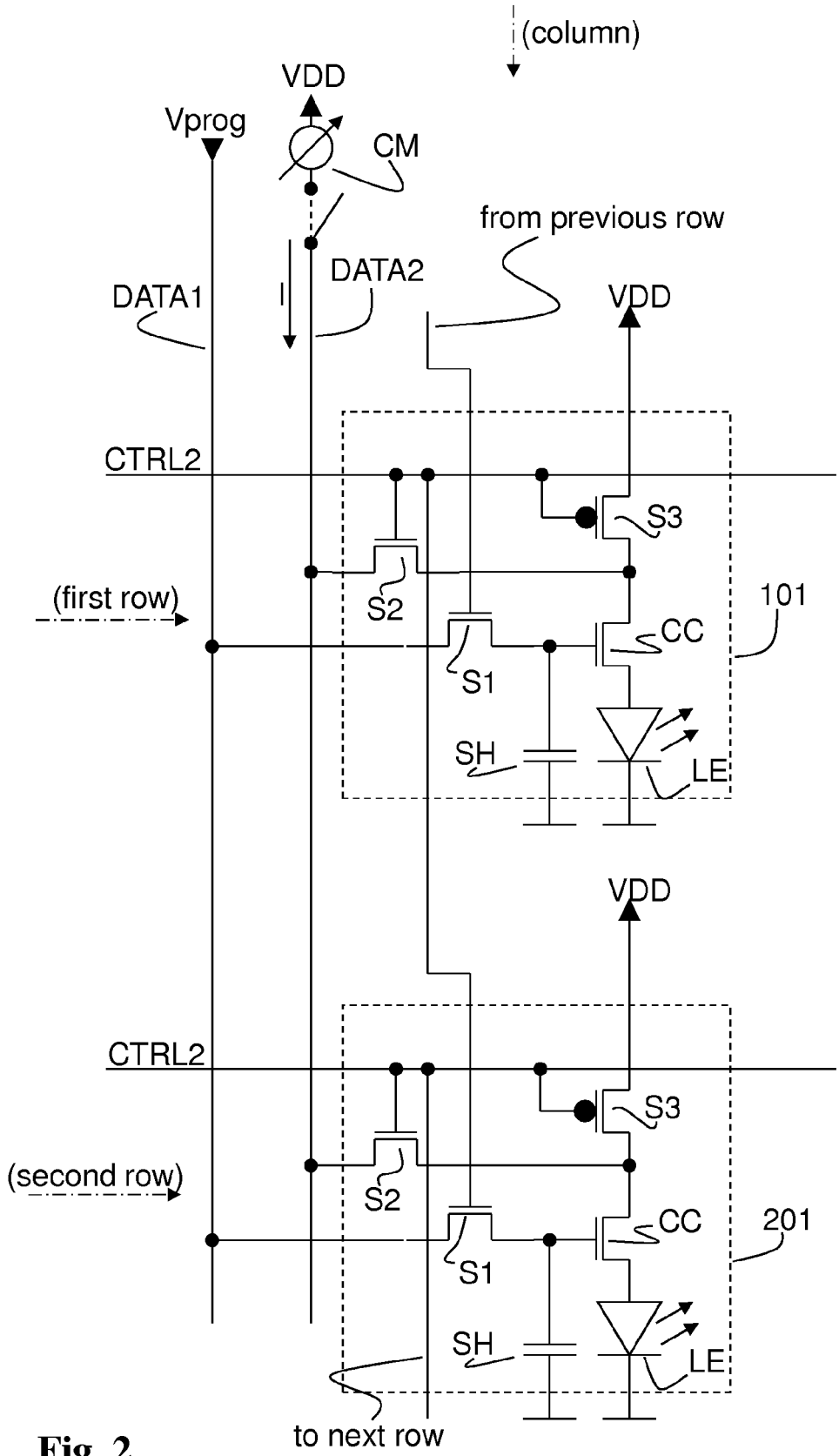
FIG. 2 shows a detail of a luminous display according to a second embodiment of the invention.

In a luminous display according to a second embodiment of the invention a multiplicity of pixel cells 101, 201 are arranged in rows and columns, wherein the pixel cells 101, 201 are similar to those of the first embodiment of the invention. FIG. 2 shows a detail of the luminous display according to the second embodiment of the invention. In the figure two pixel cells 101, 201 of adjacent rows of the display are shown. Different from the embodiment of the display described under FIG. 1 only second control lines CTRL2 are provided for controlling the second and the third switches S2, S3 of the pixel cells 101 arranged in one row and the first switches S1 of the pixel cells 201 arranged in the next, adjacent row. The number of second control lines CTRL2 preferably equals the number of rows in the display. Further, the third switches S3 are of a complementary type to those of the third switches S3 described in the first embodiment of the invention. As an alternative, the third switches S3 of the second embodiment of the invention are of the same type as described in the first embodiment of the invention, but are equipped with inverters for inverting the control signal applied via the second control lines CTRL2. The inversion of the signals is indicated by the solid circle at the control electrodes of the third switches S3. Similar to the display described in the first embodiment of the invention, in the display according to the second embodiment the second switches S2 of pixel cells 101 arranged in first rows and the first switches S1 of pixel cells 201 arranged in second rows, are controlled via the same second control line CTRL2, wherein the first and the second rows are adjacent to each other. Also similar to the display described in the first embodiment of the invention, in a development of the second embodiment of the invention the bottom most second control line CTRL2 of the display controls the second and third switches S2, S3 of the pixel cells 201 arranged in the bottom most row of the display and the first switches S1 of the pixel cells 101 arranged in the topmost row of the display.

A method for driving a luminous display according to the second embodiment of the invention includes the following steps: the first switch S1 of a pixel cell 201 in a second row is closed, thereby connecting the control terminal of the current control means CC to the first data line DATA1. The first switch S1 is closed by applying a corresponding signal to the second control line CTRL2 in the first row including the pixel cell 101. At the same time the signal in the second control line CTRL2 in the first row opens the third switch S3 and closes the second switch S2 of the pixel cell in the first row. Thus, the junction between the third switch S3 and the current control means CC of the pixel cell in the first row is connected to the second data line DATA2. The current through the light emitting means LE and the current control means CC of the pixel cell in the first row is now supplied and measured via the second data line DATA2. A new desired current through the current control means CC of the pixel cell in the second row is programmed via the first data line DATA1. A programming voltage Vprog is applied to the control terminal of the current control means CC via the closed first switch S1 and the first data line DATA1. After programming and measuring of the pixel cells 101, 201 the third switches S3 are closed again and the first and second switches S1, S2 are opened again, thereby resuming normal operation. Once the programming and measuring of the pixel cells 101, 201 in the first and the second row is terminated, the second row, i.e. the row including pixel cell 201 in FIG. 5, becomes the new first row and the next row, i.e. the row including pixel cell 301 in FIG. 5, becomes the new second row. The method is repeated until all the rows of the display have been programmed and measured, respectively, and then the method begins anew from the beginning, e.g. from the top row of the display, i.e. the row including the pixel cell 001, when the display is driven in a row-by-row fashion. The method allows for continuously measuring the electrical properties of the pixel cells of the display during the normal driving cycles, in which new image content is written to the display.

Figure 3:
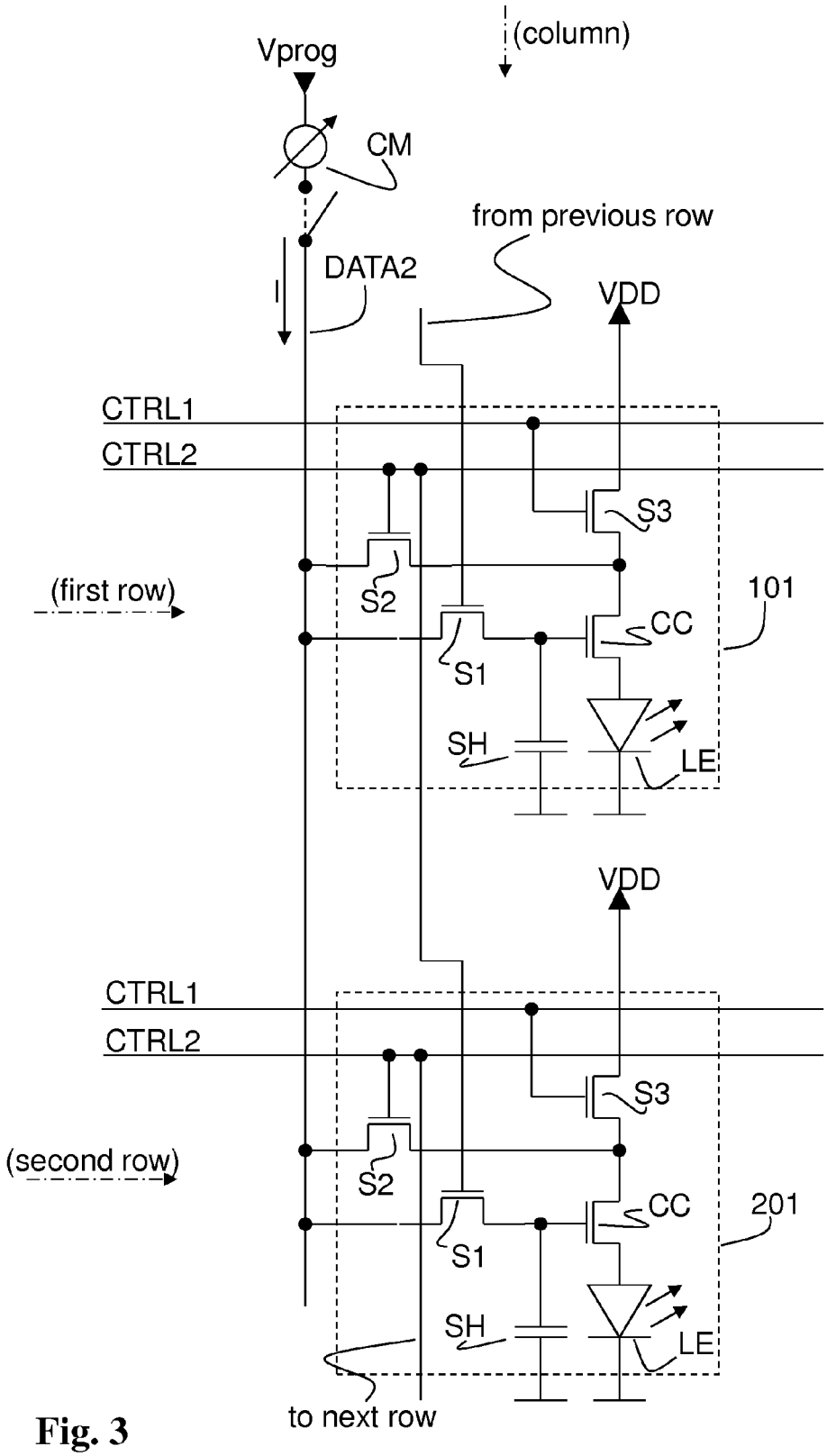
FIG. 3 shows a detail of a luminous display according to a third embodiment of the invention.

In a luminous display according to a third embodiment of the invention a multiplicity of pixel cells is arranged in rows and columns in a similar manner as was described in the first and the second embodiment. FIG. 3 shows a detail of the luminous display according to the third embodiment of the invention. As in FIGS. 1 and 2 two pixel cells 101, 201 of adjacent rows of the display are shown. Again, first control lines CTRL1 are provided for controlling the third switches S3 of the pixel cells 101, 201 that are arranged in one row. The number of first control lines CTRL1 preferably equals the number of rows in the display. Similar to the display described in the first embodiment second control lines CTRL2 are provided for controlling the second switches S2 of pixel cells 101 that are arranged in first rows and the first switches S1 of pixel cells 201 that are arranged in second rows, wherein the first and the second rows 101, 201 are adjacent to each other. The number of second control lines CTRL2 preferably equals the number of rows in the display. Also similar to the display described in the first embodiment of the invention, in a development of the third embodiment of the invention the bottom most second control line CTRL2 of the display controls the second switches S2 of the pixel cells arranged in the bottom most row of the display and the first switches S1 of the pixel cells arranged in the topmost row of the display. In the third embodiment of the invention only second data lines DATA2 are provided for substantially simultaneously programming the current control means CC of the pixel cells 201 in the respective second rows and measuring the electrical properties of the pixel cells 101 in the respective first rows. The number of second data lines DATA2 preferably equals the number of columns in the display. According to the third embodiment of the invention, a programming voltage Vprog is applied to the respective second data lines DATA2 via current measuring means CM. In the respective second rows the current controlling means CC are programmed via the closed first switches S1, which connect the control terminals of the current control means CC to the respective second data lines DATA2. In the respective first rows the closed second switches S2 connect the junction between the third switches S3 and the current controlling means CC to the respective second data lines DATA2. In this way it is possible, after the charging current into the signal holding means SH that are associated to the current control means CC has settled, to measure the current through the current control means CC of those pixel cells that have been programmed before, using only one single data line for all pixel cells that are arranged in one column. Expediently the programming voltage respects a possible voltage drop across the current measuring means CM. It is also possible to measure the programming voltage at the far end of the second data line DATA2, i.e. that end of the second data line DATA2 that is not supplying the programming voltage Vprog and the supply current for that pixel is cell which is currently operated through the second data line DATA2. It is to be noted that the programming voltage has to be high enough to be able to deliver the desired current for that pixel cell which is currently supplied through the second data line DATA2.

A method for driving a luminous display according to the third embodiment of the invention includes the following steps: the third switch S3 of a pixel cell 101 in a first row is opened in order to interrupt the current flow through the current control means CC and the light emitting element LE. Opening of the third switch S3 of the pixel cell is done by accordingly applying a signal to the first control line CTRL1 in the first row. The first switch S1 of the pixel cell 201 in the second row is closed, thereby connecting the control terminal of the current control means CC to the second data line DATA2. A programming voltage Vprog is applied to the control terminal of the current control means CC via the closed first switch S1 and the second data line DATA2. The first switch S1 of the pixel cell 201 in the second row is controlled by an according signal in the second control line CTRL2 in the first row. The signal in the second control line CTRL2 in the first row also closes the second switch S2 of the pixel cell 101 in the first row, thereby connecting the junction between the third switch S3 and the current control means CC with the second data line DATA2. The third switch S3 in the pixel cell 101 in the first row of the display is opened by accordingly applying a signal to the first control line CTRL1 in the first row. Doing so the current flow through the current control means CC and the light emitting element LE of the pixel cell 101 in the first row would be interrupted. However, the programming voltage Vprog applied to the respective second data lines DATA2 via current measuring means CM supplies the operating current for the pixel cell 101 in the first row, as the closed second switch S2 connects the junction between the third switches S3 and the current controlling means CC with the respective second data lines DATA2. In the respective second row the current controlling means CC is programmed via the closed first switch S1, which connect the control terminal of the current control means CC to the second data line DATA2. In this way it is possible, after the charging current into the signal holding means SH that are associated to the current control means CC has settled, to measure the current through the current control means CC of those pixel cells that have been programmed before, using only one single data line for all pixel cells that are arranged in one column. After programming and measuring of the pixel cells 101, 201 the third switches S3 are closed again and the first and second switches S1, S2 are opened again. Once the programming and measuring of the pixel cells 101, 201 in the first and the second row is terminated, the second row, i.e. the row including pixel cell 201 in FIG. 5, becomes the new first row and the next row, i.e. the row including pixel cell 301 in FIG. 5, becomes the new second row. The method is repeated until all the rows of the display have been programmed and measured, respectively. Then the method begins anew from the beginning, e.g. from the top row of the display, i.e. the row including the pixel cell 001, when the display is driven in a row-by-row fashion. The method allows for continuously measuring the electrical properties of the pixel cells of the display during the normal driving cycles, in which new image content is written to the display. It is to be noted that opening the third switch S3 is not necessary for performing the programming of the current control means CC of a pixel cell. In this case a possible change in the current that is programmed is visible as an increasing or decreasing brightness of the light emitting means LE. In case the third switch S3 is opened prior to programming a new current those light emitting elements LE the current control means CC of which are programmed when not emit any light during programming.

Figure 4:
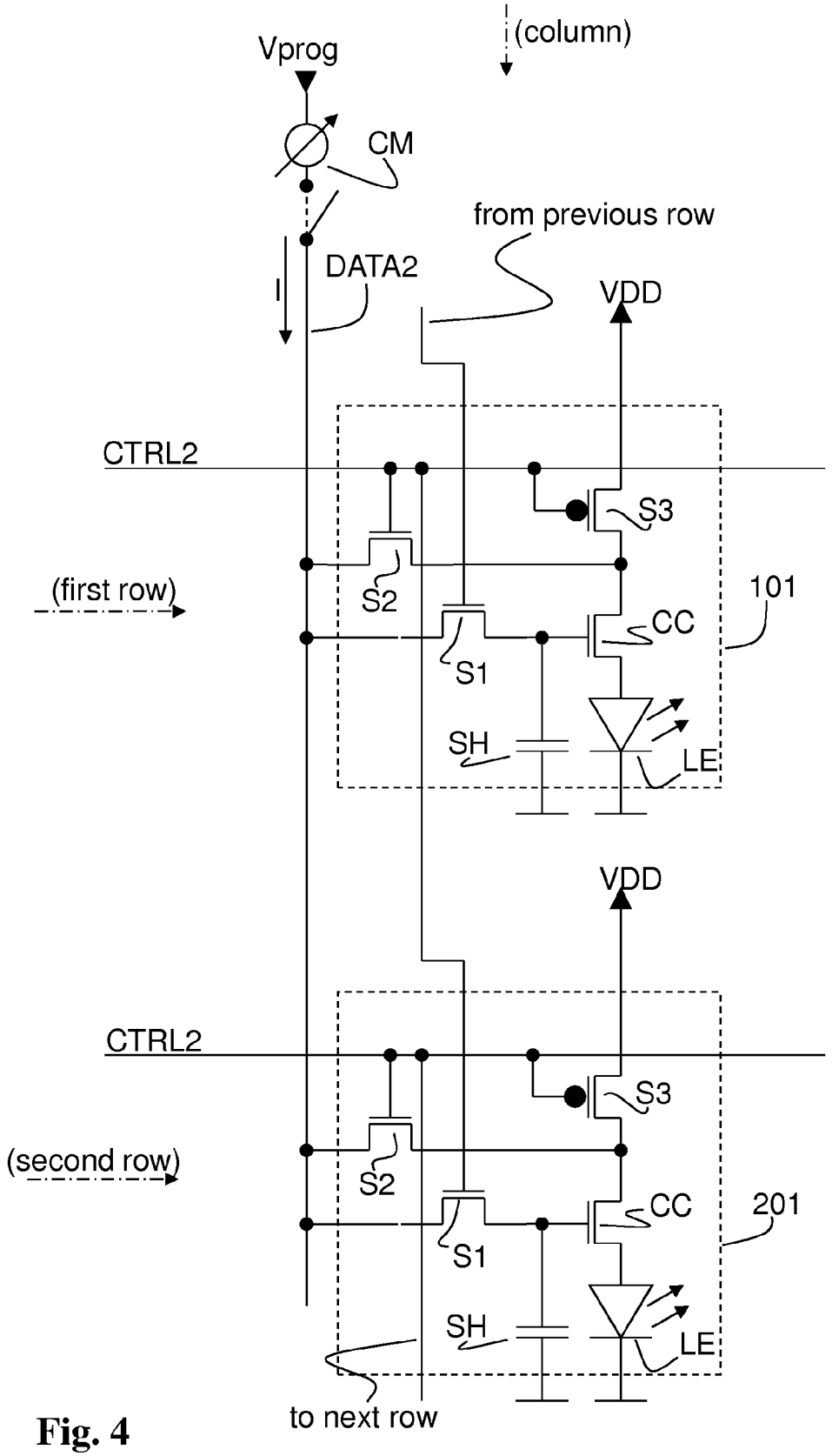
FIG. 4 shows a detail of a luminous display according to a fourth embodiment of the invention.

In a luminous display according to a fourth embodiment of the invention a multiplicity of pixel cells is arranged in rows and columns in a similar manner as was described in the first, second and third embodiment. FIG. 4 shows a detail of the luminous display according to the fourth embodiment of the invention. As in FIGS. 1, 2 and 3 two pixel cells 101, 201 of adjacent rows of the display are shown. Similar to the second embodiment of the display described under FIG. 2 only second control lines CTRL2 are provided for controlling the second and the third switches S2, S3 of the pixel cells 101 arranged in one row and the first switches S1 of the pixel cells 201 arranged in the next, adjacent row. The number of second control lines CTRL2 preferably equals the number of rows in the display. Further, the third switches S3 are of a complementary type to those of the third switches S3 described in the first and third embodiment of the invention. As an alternative, the third switches S3 of the fourth embodiment of the invention are of the same type as described in the first and third embodiment of the invention, but are equipped with inverters for inverting the control signal applied via the second control lines CTRL2. The inversion of the signals is indicated by the solid circle at the control terminals of the third switches S3. Similar to the all displays described before, in a development of the fourth embodiment of the invention the bottom most second control line CTRL2 of the display controls the second and the third switches S2, S3 of the pixel cells arranged in the bottom most row of the display and the first switches S1 of the pixel cells arranged in the topmost row of the display. Similar to the third embodiment described under FIG. 3 in the fourth embodiment of the invention only second data lines DATA2 are provided for substantially simultaneously programming the current control means CC of the pixel cells 201 in the respective second rows and measuring the electrical properties of the pixel cells 101 in the respective first rows. The number of second data lines DATA2 preferably equals the number of columns in the display. According to the fourth embodiment of the invention, a programming voltage Vprog is applied to the respective second data lines DATA2 via current measuring means CM. In the respective second rows the current controlling means CC are programmed via the closed first switches S1, which connect the control terminals of the current control means CC to the respective second data lines DATA2. In the respective first rows the closed second switches S2 connect the junction between the third switches S3 and the current controlling means CC to the respective second data lines DATA2. In this way it is possible, after the charging current into the signal holding means SH that are associated to the current control means CC has settled, to measure the current through the current control means CC of those pixel cells that have been programmed before, using only one single data line for all pixel cells that are arranged in one column. Expediently the programming voltage respects a possible voltage drop across the current measuring means CM. It is also possible to measure the programming voltage at the far end of the second data line DATA2, i.e. that end of the second data line DATA2 that is not supplying the programming voltage Vprog and the supply current for that pixel is cell which is currently operated through the second data line DATA2. It is to be noted that the programming voltage has to be high enough to be able to deliver the desired current for that pixel cell which is currently supplied through the second data line DATA2.

A method for driving a luminous display according to the fourth embodiment of the invention includes the following steps: the third switch S3 of a pixel cell 101 in a first row is opened in order to interrupt the current flow through the current control means CC and the light emitting element LE. Opening of the third switch S3 of the pixel cell is done by accordingly applying a signal to the second control line CTRL2 in the first row. The first switch S1 of the pixel cell 201 in the second row is closed, thereby connecting the control terminal of the current control means CC to the second data line DATA2. A programming voltage Vprog is applied to the control terminal of the current control means CC via the closed first switch S1 and the second data line DATA2. The first switch S1 of the pixel cell 201 in the second row is controlled by the same signal of the second control line CTRL2 in the first row of the display as the third switch S3 in the pixel cell 101 of the first row, which was opened in the preceding step. The signal in the second control line CTRL2 in the first row further also closes the second switch S2 of the pixel cell 101 in the first row, thereby connecting the junction between the third switch S3 and the current control means CC with the second data line DATA2. As the third switch S3 of the pixel cell 101 in the first row is opened the current flow through the current control means CC and the light emitting element LE of the pixel cell 101 in the first row would be interrupted. However, the programming voltage Vprog applied to the respective second data lines DATA2 via current measuring means CM supplies the operating current for the pixel cell 101 in the first row, as the closed second switch S2 connects the junction between the third switch S3 and the current controlling means CC with the respective second data lines DATA2. In the respective second rows the current controlling means CC are programmed via the closed first switches S1, which connect the control terminal of the current control means CC to the respective second data line DATA2. In this way it is possible, after the charging current into the signal holding means SH that are associated to the current control means CC has settled, to measure the current through the current control means CC of those pixel cells that have been programmed before, using only one single data line for all pixel cells that are arranged in one column. After programming and measuring of the pixel cells 101, 201 the third switch S3 is closed again and the first and second switches S1, S2 are opened again. Once the programming and measuring of the pixel cells 101, 201 in the first and the second row of the display is terminated, the second row, i.e. the row including pixel cell 201 in FIG. 5, becomes the new first row and the next row, i.e. the row including pixel cell 301 in FIG. 5, becomes the new second row. The method is repeated until all the rows of the display have been programmed and measured, respectively. Then the method begins anew from the beginning, e.g. from the top row of the display, i.e. the row including the pixel cell 001, when the display is driven in a row-by-row fashion. The method allows for continuously measuring the electrical properties of the pixel cells of the display during the normal driving cycles, in which new image content is written to the display.

By staggering the programming and the measuring time instants the inventive circuit and driving method advantageously allow for the elements of those pixel cells that have been programmed to achieve a steady state prior to measuring the current through them. The inventive circuit further dispenses with an additional dedicated control line, which would otherwise be necessary to provide a staggered programming and measuring. The time that is necessary for the programming signal to settle in those pixel cells that are currently programmed can be neglected compared to the active cycle of the pixel cell.

The results of the measurements are used for adapting the nominal programming values for a desired light output depending on the electro-optical parameters, as for example, the control voltage at the respective terminal of the current control means required for a certain current to flow, or the voltage across the light emitting means.

The current measuring means CM of the first and the second embodiment of the invention can also be provided for a group of multiple columns instead for one column only. In this case it is possible to measure the current through single pixel cells by applying an according video pattern, e.g., one that illuminates only pixel cells in one column at a time. To this end the current measuring means can also be selectively connected to individual or groups of columns by switches.

Although the invention has been described with reference to a luminous display using OLEDs as light emitting elements it is obvious to the person skilled in the art that the general idea of the invention can also be applied to any other type of luminous display the luminosity of which depends on the current through the light emitting element and is set using a control voltage. The invention can thus also be applied to luminous displays using, e.g., LEDs instead of OLEDs as light emitting elements.

It is obvious to the person skilled in the art that the terms row and column for the location of pixels cells in the arrangement can be used interchangeably, and, thus, do not limit the invention to the exemplary arrangements described above.

It is further obvious that those pixel cells of one column switches of which are controlled by a common control line need not necessarily be adjacent to each other; the exemplary embodiments shown in the figures rather refer to adjacent rows for reasons of clarity.

What is claimed is:

1. A light emitting display, comprising:

pixel cells arranged in rows and columns, wherein each pixel cell includes a light emitting means and a current control means connected in series, wherein the current control means controls a current through the light emitting means, wherein each pixel cell further includes a first switch, which connects a control terminal of the current control means to a first data line, for programming a current for a current control means of a first pixel cell in a first row and measuring electrical properties of a second pixel cell in a second row, wherein each of the pixel cells includes a second switch and a signal holding means, wherein the second switch DC-connects a current conducting terminal of the current control means, via the first data line, to a means for measuring a current through the current control means after the current has settled in the signal holding means, wherein the first switch of the first pixel cell in the first row and the second switch of the second pixel cell in the second row are connected to a common control line, such that, in response to a corresponding common control signal, the first pixel cell in the first row is connected for programming while, at the same time, the second pixel cell in the second row is connected for measuring.

2. The light emitting display of claim 1, wherein a third switch is series-connected with the light emitting means and the current control means, for switchably connecting the current control means and the light emitting means to a supply voltage.

3. The light emitting display of claim 2, wherein the second and third switches of a pixel cell are controlled by a same control line, wherein an inverter is provided to invert a switching signal or wherein a switch response characteristic of the third switch is inverted compared to a switch response characteristic of the second switch.

4. The light emitting display of claim 1, wherein a means for measuring a current is selectively connected to a second data line of one of multiple columns.

5. A method of driving pixel cells arranged in rows and columns, wherein each pixel cell includes a light emitting means and a current control means connected in series, wherein the current control means controls a current through the light emitting means, wherein each pixel cell further includes a first switch, which connects a control terminal of the current control means to a first data line, for programming a current for a current control means of a first pixel cell in a first row and measuring electrical properties of a second pixel cell in a second row, wherein each of the pixel cells includes a second switch and a signal holding means, wherein the second switch DC-connects a current conducting terminal of the current control means, via the first data line, to a means for measuring a current through the current control means after the current has settled in the signal holding means, wherein the first switch of the first pixel cell in the first row and the second switch of the second pixel cell in the second row are connected to a common control line, such that, in response to a corresponding common control signal, the first pixel cell in the first row is connected for programming while, at the same time, the second pixel cell in the second row is connected for measuring, the method, during a single, combined programming and measurement cycle, including the steps of:

closing the second switch of a first pixel cell arranged in a first row and the first switch of a second pixel cell arranged in a second row by applying a control signal to the common control line, for connecting the current conducting terminal of the current control means of the first pixel cell in the first row to the first data line and the control terminal of the current control means of the second pixel cell in the second row to the first data line;

applying a programming signal to the control terminal of the current control means via the first switch and the first data line;

measuring, the current through the light emitting means of the first pixel cell arranged in the first row, the current of which has been programmed in a preceding programming cycle, via the first data line; and opening the first switch of the second pixel cell in the second row and the second switch of the first pixel cell in the first row so that the status of each of said switches remains the same during the applying step and the measuring step, and wherein the applying step and the measuring step are carried out substantially simultaneously.

6. The method of claim 5, wherein the light emitting display further includes a third switch in series-connection with the light emitting means and the current control means, for switchably connecting the current control means and the light emitting means to a supply voltage, the method further including opening the third switch prior to or when closing the second switch, and closing the third switch after measuring the current.

7. A method of driving a light emitting display having pixel cells arranged in rows and columns, wherein each pixel cell includes a light emitting means and a current control means connected in series, wherein the current control means controls a current through the light emitting means, wherein each pixel cell further includes a first switch, which connects a control terminal of the current control means to a first data line, for programming a current for a current control means of a first pixel cell in a first row and measuring electrical properties of a second pixel cell in a second row, wherein each of the pixel cells includes a second switch and a signal holding means, wherein the second switch DC-connects a current conducting terminal of the current control means, via the first data line, to a means for measuring a current through the current control means after the current has settled in the signal holding means, wherein the first switch of the first pixel cell in the first row and the second switch of the second pixel cell in the second row are connected to a common control line, such that, in response to a corresponding common control signal, the first pixel cell in the first row is connected for programming while, at the same time, the second pixel cell in the second row is connected for measuring, the method, during a single, combined programming and measurement cycle, including the steps of:

closing the second switch of a first pixel cell arranged in a first row and the first switch of a second pixel cell arranged in a second row by applying a control signal to the common control line, for connecting the current conducting terminal of the current control means of the first pixel cell in the first row and the control terminal of the current control means of the second pixel cell in the second row, to the first data line;

applying, in a single applying step, a programming signal to the control terminal of the current control means of the second pixel cell arranged in the second row, via the first data line, for programming a current through the current control means of the second pixel cell in the second row;

measuring, in a single measuring step, the current through the series-connection of the current control means and the light emitting means of the first pixel cell arranged in the first row, the current of which has been programmed in a preceding programming and measurement cycle, via the first data line; and opening of the first switch of the second pixel cell in the second row and the second switch of the first pixel cell in the first row so that the status of each of said switches remains constant throughout the entire applying and measuring step, wherein the applying step and the measuring step are carried out substantially simultaneously.

8. The method of claim 7, wherein the light emitting display further includes a third switch in series-connection with the light emitting means and the current control means, for switchably connecting the current control means and the light emitting means to a supply voltage, the method further including opening the third switch prior to or when closing the second switch, and closing the third switch after measuring the current.

9. The method of claim 8, wherein the current is measured only after a transient current related to programming the current control means has settled.

* * * * *